United States Patent [19]

Worcester et al.

[11] Patent Number: 4,849,016

[45] Date of Patent: Jul. 18, 1989

[54] COMBINED ULTRA SLOW ELECTRON BEAM AND VACUUM ARC MELTING FOR BARRIER TUBE SHELL MATERIAL

[75] Inventors: Samuel A. Worcester; Charles R. Woods; Glenn S. Galer; Richard L. Propst, all of Ogden, Utah

[73] Assignee: Westinghouse Electric Corp., Pittsburgh, Pa.

[21] Appl. No.: 134,678

[22] Filed: Dec. 18, 1987

[51] Int. Cl.[4] ..... C22B 4/00; C21C 5/52

[52] U.S. Cl. ..... 75/10.26; 75/10.23; 75/49; 75/65 EB

[58] Field of Search ..... 75/65 EB, 10.26, 10.23, 75/49

[56] References Cited

U.S. PATENT DOCUMENTS

| | | | |
|---|---|---|---|
| 2,942,098 | 6/1960 | Smith | 75/65 EB |
| 3,764,297 | 10/1973 | Coad | 75/49 |
| 4,108,644 | 8/1978 | Walberg | 75/135 |
| 4,190,404 | 2/1980 | Drs | 425/8 |
| 4,200,492 | 4/1980 | Armijo | 176/82 |
| 4,368,072 | 1/1983 | Siddall | 75/84.4 |
| 4,372,817 | 2/1983 | Armijo | 376/417 |

FOREIGN PATENT DOCUMENTS 144789 11/1979 Japan .

*Primary Examiner*—Peter D. Rosenberg
*Attorney, Agent, or Firm*—R. A. Stoltz

[57] ABSTRACT

This is a process for making a very pure and very homogeneous zirconium material for use in lining the interior of zirconium alloy fuel element cladding. The improvement utilizes the forming of consumable feed material from generally virgin sponge material, melting the consumable feed material in a multiple swept beam electron beam furnace with a feed rate generally between 0.1 and less than about 1.0 inch per hour and then vacuum arc melting the EB melted material.

14 Claims, 1 Drawing Sheet

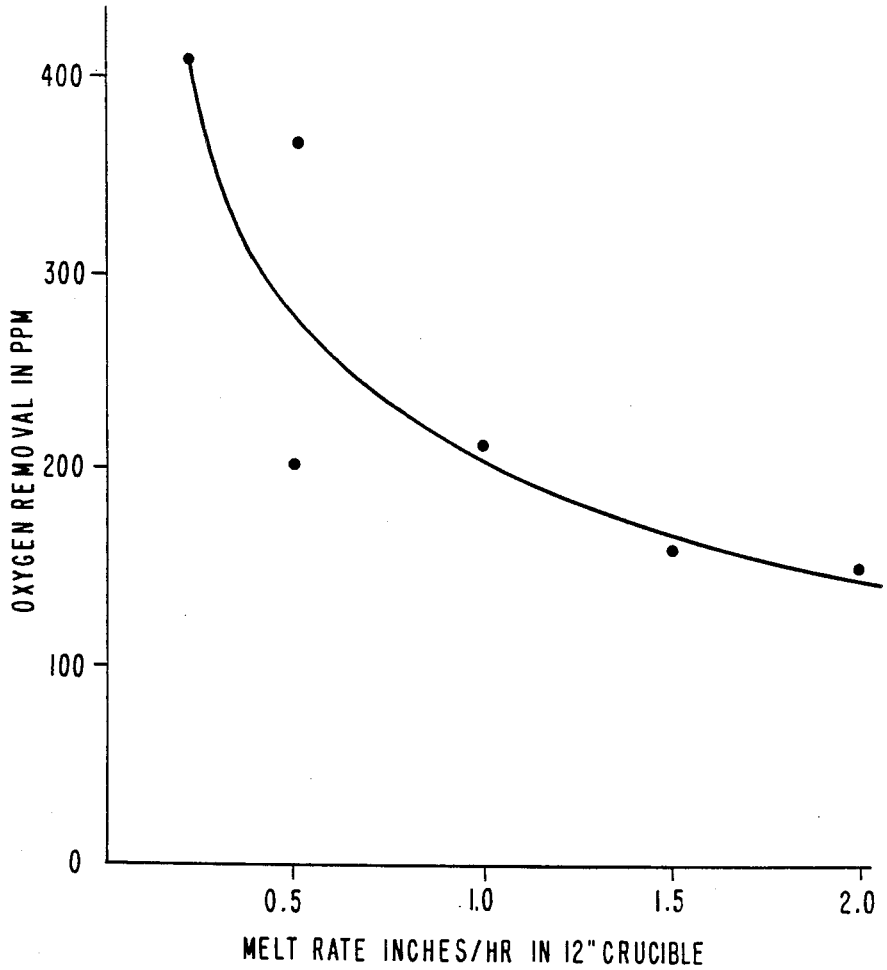
400
300
200
100
0
OXYGEN REMOVAL IN PPM
0.5
1.0
1.5
2.0
MELT RATE INCHES/HR IN 12" CRUCIBLE

COMBINED ULTRA SLOW ELECTRON BEAM AND VACUUM ARC MELTING FOR BARRIER TUBE SHELL MATERIAL

CROSS-REFERENCE TO RELATED APPLICATIONS

A related process is described in copending application Ser. No. 80,151, filed July 30, 1987, (now allowed) which was in turn a continuation of Ser. No. 871,183, filed June 5, 1986, also produces high purity (but not as pure) material for the same uses as the instant invention and uses a faster electron-beam melting step (broadly at 1–20, and typically at about 4–16 inches per hour), and utilizes a vacuum arc melting step after the EB melting to homogenize the material.

Application Ser. No. 780,342, filed Sept. 26, 1985, (now allowed) describes a process for producing zirconium or hafnium utilizing a precharge of molten salt during reduction of zirconium tetrachloride to metal. The process uses a combination reduction-distillation vessel. The precharge of salt prevents reduction of metal outside the liner, facilitating removal of the liner after the reduction-distillation is completed. Copending application Ser. No. 780,343, filed Sept. 26, 1985 (now U.S. Pat. No. 4,772,827) describes a high purity material having 500–1000 ppm of total impurities. Such material might be produced, for example, by the aforementioned process in Ser. No. 780,392 in a combined reduction-distillation vessel.

A related process is described in copending application Ser. No. 102,312 filed Sept. 25, 1987, as a continuation of Ser. No. 871,182, filed June 5, 1986. That related application also produces high purity material, utilizing an electron-beam melting step following prebaking of the material for at least one-half hour at a temperature controlled between 250° C. and 400° C. and produces a low iron (50–300 ppm) low oxygen (250–350 ppm) for use as a liner material for reactor fuel element cladding.

A related process is described in copending application No. 30,007, filed Mar. 23, 1987, (now U.S. Pat. No. 4,711,664) which produces zirconium with a low iron content, that application utilizes a modified, somewhat lower temperature distillation step (the distillation step, which is after reduction, but prior to melting, removes magnesium chloride and magnesium from the zirconium sponge produced by the reduction).

A method for the reduction of the oxygen content in magnesium (which low oxygen content magnesium may in be used in producing low oxygen zirconium), is described in copending application Ser. No. 17,301, filed Feb. 20, 1987 now abandoned. In that application, magnesium, in a molten state is contacted by a solid particulate metal such as zirconium or titanium. When the molten magnesium is separated from the particulate metal, the oxygen content of the magnesium metal has been substantially reduced. In addition, nickel, iron, chromium, and aluminum content of the magnesium may also be reduced.

Copending application Ser. No. 111,231, filed Oct. 22, 1987 provides an ultra-pure alloy of tin and zirconium which provides a ductile, but reliably fabricatible liner material having somewhat better corrosion resistance than unalloyed zirconium, and also believed to give better crack propagation resistance under irradiation at a reliably fabricatible hardness than any other material.

Copending application Ser. No. 111,230, filed Oct. 22, 1987, utilizes ultra slow EB melting to give oxygen reduction and high purity, and requires alloying during vacuum arc melting (as compared to the instant invention which precludes alloying) for liner material.

The preceding applications are all assigned to the same assignee and are all hereby incorporated by reference.

BACKGROUND OF THE INVENTION

1. Field of the Invention

This is a metal purification process for zirconium.

This invention relates to high purity zirconium and in particular to electron-beam melting followed by vacuum arc melting.

2. Description of the Related Art

The conventional process for making zirconium metal utilizes a fluidized bed process in which the ore is subjected to a chlorination step which produces a relatively impure, hafnium-containing zirconium tetrachloride and by-product silicon tetrachloride (which by-product is relatively easily separated). The hafnium and zirconium containing material is then subjected to a number of purifying operations and also a complex hafnium separation operation. These operations result in purified oxides of zirconium and hafnium, which, of course, are maintained separate. The purified oxides are separately chlorinated. Zirconium and hafnium are commonly reduced from the chloride by means of a reducing metal, typically magnesium. At the present time, the commercial processes are batch-type processes. U.S. Pat. No. 3,966,460, for example, describes a process of introducing zirconium tetrachloride vapor onto molten magnesium, with the zirconium being reduced and traveling down through the magnesium layer to the bottom of the reactor and forming a metallic sponge. The metallic sponge (containing remaining chloride and some remaining excess reducing metal) is then placed in a distillation vessel for removal of the remaining salt and reducing metal by high temperature vacuum distillation. The sponge material is generally crushed, screened and pressed into electrodes for vacuum arc melting. Particularly, the material is multiple (typical double or triple) vacuum arc melted to provide ingots which are then further fabricated into various shapes. Most of the zirconium currently is used to produce Zircaloy.

Commercial nuclear reactors generally have used Zircaloy tubes as cladding material to contain the uranium dioxide fuel. Generally a Zircaloy ingot is processed into a so-called "trex" and pilgering operations are used to reduce the trex inside diameter and wall thickness to size. Ultrapure zirconium has been proposed for a liner for the inside surface of Zircaloy tubing which is used as a cladding for nuclear fuel and is described in, for example, U.S. Pat. No. 4,372,817 to Armijo et al. on Feb. 8, 1983. A similar use of moderate purity material is proposed in U.S. Pat. No. 4,200,492 to Armijo et al. on Apr. 29, 1980. The ultrapure zirconium material described has been purified by iodide cells to produce so called "crystal bar" material. This rather expensive crystal bar processing is performed after reduction and is described, for example, in U.S. Pat. No. 4,368,072 issued to Siddal on Jan. 11, 1983.

EB (electron-beam) melting of materials, including zirconium has been discussed in a number of patents. EB melting has been used to consolidate crushed particles or chips in so called hearth furnaces and to separate impurities by either overflowing floating inclusions (4,190,404 to Drs et al. on Feb. 26, 1980) or to produce an electrode for arc melting (4,108,644 to Walberg et al. on Aug. 22, 1978). A number of U.S. Patents have used EB melting of powders or granules, often producing an ingot in a chilled mold. These powder melting EB patents include 2,942,098 to Smith on June 21, 1960; 2,960,331 to Hanks on Nov. 15, 1960; 2,963,530 to Hanks et al. on Dec. 6, 1960; 2,997,760 to Hanks et al. on Aug. 29, 1961; 2,935,395 to Smith on May 3, 1960; and 4,482,376 to Tarasescu et al. on Nov. 13, 1984. Electron-beam zone refining using multiple passes is described in U.S. Pat. No. 3,615,345 to King on Oct. 26, 1971.

EB melting using a consumable feed "electrode" to produce an ingot collected in a chilled mold has also been discussed in a number of patents, including 3,087,211 to Howe on Apr. 30, 1963; 3,226,223, to Bussard et al. on Dec. 28, 1965; 2,880,483 to Hanks et al. on Apr. 7, 1959; and 4,130,416 to Zaboronok et al. on Dec. 19, 1978. U.S. Pat. No. 3,219,435 to Gruber et al. on Nov. 23, 1965 shows a commercial type EB furnace utilizing multiple beams. Typically the beams are directed to the surface of the molten pool and are continually swept across the pool surface to avoid overheating of any single portion of the pool surface. U.S. Pat. No. 3,091,525 to D'A. Hunt on May 28, 1963 describes adding a small amount of zirconium, for example, to hafnium, for example and melting in an EB furnace to deoxidize the hafnium. Japanese application No. 1979-144789, published as patent report 1981-67788 by Kawakita describes the use of a very small ingot with a high power density and ultra slow melting to produce a deep molten pool to produce a high purity ingot directly usable for lining of Zircaloy tubing for nuclear reactor applications. Such laboratory sized apparatus with its high power consumption and very low throughput is, of course, not practical for commercial production.

SUMMARY OF THE INVENTION

This is a process for making very pure and very homogeneous zirconium material for use in the lining of the interior of zirconium alloy fuel element cladding. Generally this process provides material much purer than the so called sponge material and essentially as pure as the crystal bar material, at a fraction of the cost of crystal bar material. The material of this process has oxygen in the less than 400 ppm range (and preferably less than about 300, and most preferably less than 175) and iron less than 100 ppm (and preferably less than 50 ppm). Total impurities are less than 1000 ppm and can be less than 500 (total impurities for these purposes generally comprise the elements listed in the aforementioned U.S. Pat. No. 4,200,492).

This process is an improvement on the process wherein zirconium tetrachloride is reduced to produce a metallic zirconium sponge, the sponge is distilled to generally remove residual magnesium and magnesium chloride salt and the distilled sponge is melted to produce a final ingot. The improvement comprises forming the distilled sponge into consumable feed material (possibly in the form of a consumable electrode), melting the consumable feed material in a production (i.e., multiple swept beam) electron-beam furnace with a feed rate of less than about 1 inch per hour (generally between 0.1 to less than about 1 inch per hour) and collecting the melted material to form an intermediate ingot. The intermediate ingot is then vacuum arc melted without alloying additives to produce a final ingot. The product of this process is relatively inexpensive as compared to other material of similar purity, homogeneous, yet low in both oxygen and iron.

Preferably the energy input via the electron beams is maintained to a moderate level such that the molten pool on the upper portion of the intermediate ingot has a depth of less than about one fourth of the ingot diameter, thus lowering power costs. Preferably an argon sweep is provided in the electron-beam furnace during melting. Multiple passes may be made both through the EB furnace and the vacuum arc furnace (although generally not needed through the EB furnace at these ultra slow melting rates).

The process utilizes electron-beam melting of sponge zirconium, at a very slow feed rate (0.1 to less than about 1 inch per hour), to reduce oxygen and metallic impurities (especially aluminum and iron). The electron-beam melted zirconium is then melted in a vacuum arc furnace. Previous EB melting had been done at 4 inches per hour or faster and no discernable oxygen removal was observed, but herein melting is done at 0.1 to less than about 1 inch per hour to accomplish oxygen removal.

BRIEF DESCRIPTION OF THE DRAWING

The drawing is a graph of experimental results of oxygen removal from zirconium (initially containing about 700 ppm oxygen) as a function of melt rate (in inches/hour).

DESCRIPTION OF THE PREFERRED EMBODIMENTS

This invention provides a process for producing low iron and oxygen impurity level zirconium in which the impurities are homogeneously distributed.

The distilled zirconium sponge is formed (preferably into a consumable electrode, but possibly otherwise, e.g., granules) for consumable feed material for a production EB furnace. A typical production furnace is generally shown in the aforementioned U.S. Pat. No. 3,219,435, but with the multiple beams being constantly swept across the surface of the molten pool (as defined herein, a production EB furnace has an output "intermediate" ingot having a diameter greater than five inches, and generally greater than six inches. Preferably, a consumable electrode for EB melting is formed by compacting crushed virgin sponge (not recycle scrap). The compact and an appropriate end fitting can be welded to form the consumable electrode.

It has been found that the consumable EB feed material can be melted in a production electron beam furnace with a feed rate between 0.1 and 20 inches per hour (1–20 inches per hour being taught in the aforementioned Ser. No. 80,151). It has been found that small amounts of residual magnesium chloride remain in the electrode and absorb some moisture. Melting at faster than 20 inches per hour results in this moisture reacting to oxidized zirconium and thus causing an unacceptably high oxygen level in the product. Conversely too slow a melting rate with small ingots, while possibly removing oxygen from the molten pool (as described in the aforementioned Japanese patent publication No. 1981-67788) is uneconomical. It should be noted that significant oxygen removal from the molten pool takes considerable superheating of the molten pool and much slower melting rates and that in previous experiments no significant oxygen removal from the molten pool was found (melting rates of 4 inches per hour or faster were utilized). It has been found that a melting rate of 1 inch per hour does provide significant oxygen removal.

The drawing shows experimental results on slow EB melting. The points are actual results and the curve is the best fit curve of the results. The data fit surprisingly well, as it is difficult to measure such oxygen levels in zirconium.

Prior experiments had indicated no discernable oxygen removal at 4 inches per hour melting of zirconium containing 500–600 ppm of oxygen (oxygen removal from zirconium had apparently never previously been observed in a production-type EB furnace). It should be noted that the tightness of the furnace atmosphere had been improved between those prior experiments and the experiments of the data of FIG. 1. It should also be noted that oxygen removal is more apparent from the higher initial levels of the current experiments. Extrapolation of FIG. 1 data might indicate that there is some oxygen removal at 4 inches per hour as well. It has also been found that the level of other common impurities, for example aluminum and chromium, are also reduced by the EB furnace and are greatly reduced by ultra slow (below about 1 inch per hour) melting.

It should be noted that as used in the art (and herein and in related applications) the "feed rate" is related to material entering (or leaving) the molten pool (and thus is independent of feed electrode diameter and can be used, for example, even if unconsolidated material is utilized in a hearth type EB furnace). Feed rate is typically measured as the withdrawal rate of the output "intermediate" ingot.

Preferably, with the ultra slow melting rates, a single EB melting pass is used.

Generally an argon sweep is provided in the electron beam furnace during melting. It is felt that this helps remove moisture which has been vaporized off the electrode from the furnace, minimizing contamination of the output intermediate ingot. Preferably the argon sweep is at a flow of 10,000–1,000,000 liters per second, with the liters measured at a pressure of $10^{-5}$ Torr (rather than at standard conditions). The argon sweep can be established, for example, with pumps capable of handling 60,000 liters per second and with a pressure of $10^{-5}$ Torr measured with no argon flow, by controlling argon introduction to a rate to raise the pressure to approximately $10^{-4}$ Torr.

It should be noted that the sponge used to form the consumable electrode (or the unconsolidated feed material) is generally virgin material (as opposed to recycled scrap or turnings) and preferably is selected high quality material and generally selected for low oxygen content. Due to the great purification of ultra slow melting, however, feed material purity for this process is less critical.

Generally, after EB melting, the material is arc melted (and preferably double arc melted or even triple arc melted) to homogenize the impurity distribution. It has been found that in production EB furnaces, with their relatively shallow molten pool (the molten pool being shallow both in comparison to arc melting, where the molten pool is typically about twice the ingot diameter and in comparison to non-multiple swept beam, laboratory type furnaces where the fixed single beam covers essentially the entire surface of the molten pool and produces molten pools of about one diameter in depth) do not produce a homogeneous product. The zirconium material beneath the molten pool is, of course, solid, and can be slowly withdrawn to maintain the pool level constant as material from the feed material drips into the pool, as it is known in the prior art (and again the "feed rate" is generally measured by measuring withdrawal).

Thus, on a production EB furnace, the shallow molten pool results in a non-homogeneous product, and only by following such melting with vacuum arc melting can a homogeneous product be obtained. Conversely, small nonswept beam EB furnaces having very high power costs for very low throughput, are impractical for commercial applications. This invention lowers oxygen by removing at least some of the moisture prior to melting and, also reduces oxygen during ultra slow melting while the laboratory type of EB furnace is generally removing oxygen only from the molten pool.

In particular, typical sponge has an aluminum content of 40–50 ppm (the ASTM Spec B349-80, cited in that patent prescribes a 75 ppm maximum aluminum and 120 ppm maximum silicon). The process of this invention will give aluminum of less than 5 ppm (experimental runs produced zirconium containing less than 2 ppm of aluminum and less than 10 ppm silicon). In addition, this invention will reduce the chromium content from typically about 100 ppm (the aforementioned specification calls for 200 ppm chromium max) to less than 10 ppm chromium (typical measured numbers were about 5 ppm chromium). While chromium, unlike aluminum, is not generally considered detrimental in many zirconium alloys, reducing the chromium and silicon reduces lot-to-lot property variability due to second phase formation. The aluminum reduction reduces solid solution strengthening.

The ultra slow EB melting provides oxygen removal (as well as generally removing aluminum iron, chromium and other metallic impurities). The oxygen removal in a commercial EB furnace is very surprising as, although previously reported in a very small laboratory furnace, there had previously been no indication of any oxygen reduction in a commercial EB furnace.

The ingot of vacuum arc melted zirconium can then be fabricated into the liner of reactor fuel element cladding, providing an essentially aluminum-free material (as used herein, the term "essentially aluminum-free" means having less than 5 ppm aluminum), having less than 400 ppm oxygen. More preferably, the process is controlled to provide material containing less than 300 ppm oxygen (and most preferably less than 175 ppm). In addition, the material preferably contains less than 100 ppm iron (and most preferably less than 50 ppm iron). The material also preferably contains less than 10 ppm chromium and most preferably less than about 5 ppm chromium. Other than iron and oxygen, the material preferably contains less than 100 ppm of impurities.

Thus, the product of this process is homogeneous, has low total impurities, including low oxygen and low iron. The process is relatively inexpensive and, being compatible with existing production processes, requires little capital investment, as compared to, for example, the aforementioned copending U.S. application Ser. No. 780,343.

The invention is not to be construed as limited to the particular examples described herein, as these are to be regarded as illustrative, rather than restrictive. The invention is intended to cover all processes which do not depart from the spirit and scope of the invention.

We claim:

1. In combination with a process of the type wherein zirconium tetrachloride is reduced to produce a metallic zirconium sponge, the sponge is distilled to generally remove residual magnesium and magnesium chloride, and the distilled sponge is melted to produce an ingot, the improvement for making a non-crystal bar material for use in lining the interior of zirconium alloy fuel element cladding which comprises:

a. forming said distilled sponge into consumable feed material;

b. melting said consumable feed material in a multiple swept beam, electron beam furnace with a feed rate between 0.1 and less than about 1 inch per hour to form an intermediate ingot; and c. vacuum arc melting said intermediate ingot to produce a homogeneous very high purity zirconium final ingot, having less than 100 ppm iron and less than 400 ppm oxygen.

2. The process of claim 1, wherein said intermediate ingot has a molten pool on its upper portion, with said molten pool having a depth of less than about one fourth of an ingot diameter.

3. The process of claim 1, wherein an argon sweep is provided in said electron beam furnace during said melting.

4. The process of claim 3, wherein said argon sweep is at a flow of 10,000–1,000,000 liters per second, measured at a pressure $10^{-5}$ Torr.

5. The process of claim 1, wherein multiple passes are made through said electron beam furnace.

6. The process of claim 1, wherein virgin sponge material is utilized.

7. The process of claim 1, wherein said intermediate ingot has a diameter of greater than 5 inches.

8. In combination with a process of the type wherein zirconium tetrachloride is reduced to produce a metallic zirconium sponge, the sponge is distilled to generally remove residual magnesium and magnesium chloride, and the distilled sponge zirconium is melted to produce an ingot, the improvement for making a non-crystal bar material for use in lining the interior of zirconium alloy fuel element cladding which comprises a. forming said distilled sponge zirconium into a consumable electrode;

b. melting said consumable electrode in a multiple swept beam electron-beam furnace with a feed rate between 0.1 and less than about 1.0 inch per hour to form an electron-beam melted zirconium ingot; and c. vacuum arc melting said electron-beam melted zirconium ingot to produce a homogeneous final zirconium ingot having less than 100 ppm iron and less than 400 ppm of oxygen.

9. The process of claim 2, wherein said final ingot has less than 300 ppm of oxygen and less than 50 ppm of iron.

10. The process of claim 9, wherein said final ingot has less than 175 ppm of oxygen.

11. A process for making an electron beam melted fuel element liner material from sponge zirconium, said process comprising:

a. electron beam melting sponge zirconium at a melting rate of less than 1 inch per hour to form an electron beam melted zirconium material containing less than 300 ppm iron, less than 400 ppm oxygen, and less than 5 ppm aluminum; and b. vacuum arc melting said electron beam melted zirconium in a vacuum arc furnace without alloying additives.

12. The process of claim 11, wherein said electron beam melting is at 1/10–½ inch per hour.

13. The process of claim 11, wherein the electron melted zirconium contains less than 100 ppm iron, and less than 300 ppm oxygen and less than 100 ppm of other impurities.

14. The process of claim 11, wherein the electron beam melted zirconium contains less than 175 ppm oxygen and less than 50 ppm iron.

* * * * *